US007690778B2

(12) United States Patent
Cai et al.

(10) Patent No.: US 7,690,778 B2
(45) Date of Patent: Apr. 6, 2010

(54) PRINTHEAD AUTO-ALIGNMENT DETECTION SYSTEM THAT USES A PRINTED PRINTHEAD ALIGNMENT PATTERN COTAINING FLUORESCING MATERIAL

(75) Inventors: Xiaorong Cai, Lexington, KY (US); Xuan-Chao Huang, Lexington, KY (US); Richard L. Reel, Georgetown, KY (US); Ajay Kanubhai Suthar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 192 days.

(21) Appl. No.: 11/774,628

(22) Filed: Jul. 9, 2007

(65) Prior Publication Data

US 2009/0015620 A1 Jan. 15, 2009

(51) Int. Cl.
*B41J 2/17* (2006.01)

(52) U.S. Cl. ..... 347/96; 347/98

(58) Field of Classification Search ..... 347/96, 347/98

See application file for complete search history.

(56) References Cited

U.S. PATENT DOCUMENTS 5,221,334 A 6/1993 Ma et al.
5,712,338 A 1/1998 Donovan et al.
5,714,538 A 2/1998 Beach et al.
5,821,283 A 10/1998 Hesler et al.
5,915,864 A * 6/1999 Austin et al. ..... 400/708
6,281,908 B1 8/2001 Gibson et al.
6,450,607 B1 9/2002 Bolash et al.
6,485,124 B1 11/2002 King et al.
6,561,643 B1 * 5/2003 Walker et al. ..... 347/105
6,616,261 B2 9/2003 Harrington, III et al.
6,655,777 B2 12/2003 Adkins et al.
7,044,573 B2 5/2006 King et al.
2004/0125162 A1 * 7/2004 Valero et al. ..... 347/16

* cited by examiner

*Primary Examiner*—Matthew Luu
*Assistant Examiner*—Brian J Goldberg

(57) ABSTRACT

A printhead auto-alignment detection system includes a UV LED configured and positioned to transmit light in ultraviolet wavelengths onto a printed printhead alignment pattern formed using an aqueous ink having a UV fluorescing material. A sensor is configured and positioned to detect light in visible wavelengths emitted by the fluorescing material. A controller is communicatively coupled to the UV LED and the sensor. The controller is configured to execute program instructions for controlling the output of the UV LED and for reading a signal output of the sensor during a printhead alignment operation.

16 Claims, 5 Drawing Sheets

PRINTHEAD AUTO-ALIGNMENT DETECTION SYSTEM THAT USES A PRINTED PRINTHEAD ALIGNMENT PATTERN COTAINING FLUORESCING MATERIAL

FIELD OF THE INVENTION

The present invention relates to ink jet printers, and, more particularly, to a printhead auto-alignment detection system that uses a printhead alignment pattern containing fluorescing material.

BACKGROUND OF THE INVENTION

In the media printing environment it is important to assure that a printing onto a media is performed accurately. For example, in an inkjet printer environment, if the inkjet printhead is out of alignment, the ink will not print on a media in the proper position. To verify the alignment of a printing apparatus, typically an alignment detector is utilized to review predetermined marks made on a media to determine whether the printing apparatus that printed such marks is in alignment.

The alignment detector typically includes at least three components, a light source, an alignment sensor, and a housing to hold both the light source and the sensor, though the housing is not necessary.

Many ink jet printers include a printhead auto-alignment detector that may be used to automatically calculate and correct for various printhead misalignments including, for example, horizontal misalignment between two printheads, vertical misalignment between two printheads, bi-directional misalignment of a printhead, and skew misalignment of a printhead. The auto-alignment detector typically includes at least three components, a light source, an alignment sensor, and a housing to one printer configuration, for example, the printer performs printhead auto-alignment using a carrier mounted printhead auto-alignment detector that moves with the printhead carrier across a printed test pattern of ink marks or blocks.

For example, one known technique to determine bi-directional misalignment is to print a plurality of rectangular blocks along the main scanning axis, i.e., the scanning axis of the printhead, with odd blocks printed from left to right and with even blocks printed from right to left with the intent of placing an even block exactly midway between two adjacent odd blocks. After printing, in one technique, the sensor is passed over the pattern to measure the distances between adjacent blocks, such as for example, by using the position encoder of the printhead carrier or by using a timer and the known speed of the sensor. Unequal distances are a measure of bi-directional misalignment which, in one technique, is corrected for by advancing or delaying the firing times when printing right to left so that, in the case of the test pattern, the blocks from bi-directional printing are printed an equal distance apart.

Ink jet printers and all-in-one (AIO) devices that include a scanner part and a printer part have increased their reliance on auto alignment, and there is a desire to place more and more information on the auto alignment page. Examples of auto alignment technology for ink jet printers and all-in-one (AIO) devices that include a scanner part and a printer part are described in U.S. Pat. Nos. 7,044,573; 6,655,777; 6,616,261; 6,485,124; 6,450,607; and 6,281,908, all of which are incorporated herein by reference.

Many current Ink jet printers and all-in-one (AIO) devices that include a scanner part and a printer part have an auto-alignment feature that uses two LED's and a sensor to align each color ink individually. The LED's are different colors because each ink has a different peak reflectance wavelength and one color of LED may "see" one ink well, but not another. For example, when the auto-alignment detector only used a red LED, the cyan nozzles could be aligned well and the magenta nozzles could be aligned with a little more optimization but the yellow nozzles could not be aligned. With a red LED, the yellow ink was not distinguishable from the white paper. A blue LED has to be added to the auto-alignment detector so that the yellow nozzles could be aligned.

What is needed in the art is a method for simplifying the auto-alignment detection by only requiring the use of a single LED and further, to improve the performance for auto-alignment and any color correction method integrated into the printer.

SUMMARY OF THE INVENTION

The present invention provides a pigment ink formulation containing a fluorescing material and a method for printhead auto-alignment. The fluorescing material is first added into the pigment inks. A detecting unit comprised of an UV (ultraviolet) LED and a sensor can then be used to detect the fluorescent emission from the pigment inks. The detecting unit can detect all three color inks and perform the alignment tasks.

As discussed below, the present invention simplifies the auto-alignment detector by only requiring the use of a single LED and further, can improve the performance for auto-alignment and any color correction method integrated into the printer.

Many current inkjet printers have an auto-alignment feature that uses two LED's and a sensor to align each color ink individually. The LED's are different colors because each ink has a different peak reflectance wavelength and one color of LED may "see" one ink well, but not another. For example, when the auto-alignment detector only used a red LED, the cyan nozzles could be aligned well and the magenta nozzles could be aligned with a little more optimization but the yellow nozzles could not be aligned. With a red LED, the yellow ink was not distinguishable from the white paper. A blue LED has to be added to the auto-alignment detector so that the yellow nozzles could be aligned.

The present invention, in one form thereof, is directed to a printhead auto-alignment detection system. The system includes a UV LED configured and positioned to transmit light in ultraviolet wavelengths onto a printed printhead alignment pattern formed using an aqueous ink having a UV (ultraviolet) fluorescing material. A sensor is configured and positioned to detect light in visible wavelengths emitted by the fluorescing material. A controller is communicatively coupled to the UV LED and the sensor. The controller is configured to execute program instructions for controlling the output of the UV LED and for reading a signal output of the sensor during a printhead alignment operation.

In the present invention, a fluorescing material is added to and mixed uniformly with the inks. The fluorescing material has a narrow absorbing band and narrow emitting band such that when the light within the narrow absorbing band excites on the mixed inks, the signal within the narrow emitting band comes only or mainly from the added fluorescing material (none or very little comes from the inks themselves). For example, a fluorescing material can be used that absorbs light in the non-visible spectrum of light (below 400 nm-UV) and re-emits light in the visible or near-IR spectrum of light (about 400 nm to 1000 nm).

Because of the fluorescing material in the ink, there only needs to be one LED with a peak wavelength that is the same as or very close to the wavelength that the fluorescing material absorbs. This LED preferably has a peak wavelength in the UV region (300 nm-400 nm). Second, the sensor needs to block the 300 nm-500 nm range of wavelengths. This would block the reflected UV light from the LED and the emission from any optical brighteners in the paper. Thus the auto-alignment sensor unit can "see" all inks equally well and in some cases even better than what is possible with current systems.

All percentages and ratios, used herein, are "by weight" unless otherwise specified. All molecular weights, used herein, are weight average molecular weights unless otherwise specified.

Additional embodiments, objects and advantages of the present invention will be further apparent in view of the following detailed description.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate one preferred embodiment of the invention, in one form, and such exemplifications are not to be construed as limiting the scope of the invention in any manner.

DETAILED DESCRIPTION OF THE INVENTION

The present invention provides a pigment ink formulation containing a fluorescing material and a method for printhead auto-alignment. The fluorescing material is first added into the pigment inks. A detecting unit comprised of an UV LED and a sensor can then be used to detect the fluorescent emission from the pigment inks. The detecting unit can detect all three color inks and perform the alignment tasks.

Many current inkjet printers have an auto-alignment feature that uses two LED's and a sensor to align each color ink individually. The LED's are different colors because each ink has a different peak reflectance wavelength and one color of LED may "see" one ink well, but not another. For example, when the auto-alignment detector only used a red LED, the cyan nozzles could be aligned well and the magenta nozzles could be aligned with a little more optimization but the yellow nozzles could not be aligned. With a red LED, the yellow ink was not distinguishable from the white paper. A blue LED has to be added to the auto-alignment detector so that the yellow nozzles could be aligned.

As discussed below, the present invention simplifies the auto-alignment detector by only requiring the use of a single LED and further, can improve the performance for auto-alignment and any color correction method integrated into the printer.

Figure 1:
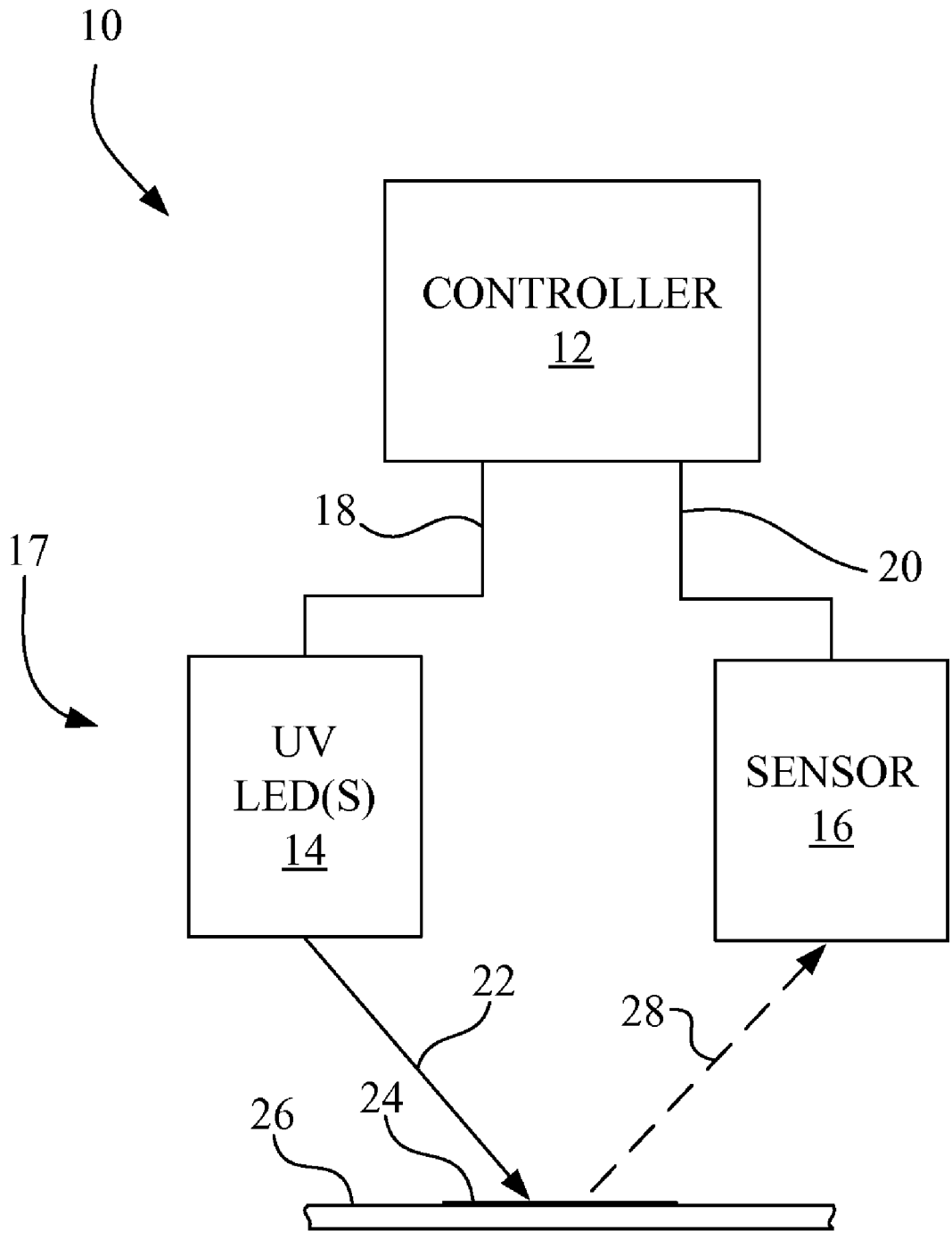
FIG. 1 shows an exemplary printhead auto-alignment system configured in accordance with an embodiment of the present invention.

FIG. 1 shows an exemplary printhead auto-alignment detection system 10 configured in accordance with an embodiment of the present invention. Printhead auto-alignment detection system 10 includes a controller 12, at least one UV light emitting diode (LED) 14, and a sensor 16 (auto-alignment). The combination of the UV LED 14 and sensor 16 form a printhead auto-alignment detector (detecting unit) 17. Controller 12 is communicatively coupled to UV LED 14 and sensor 16 via communication links 18 and 20, respectively. Communication links 18 and 20 may be, for example, a wired or wireless connection.

UV LED 14 is configured and positioned to transmit light 22 in wavelengths between 250 nm to about 400 nm onto a printed printhead alignment pattern 24 formed on a print medium 26, such as a sheet of paper, using an aqueous ink having a UV fluorescing material. Sensor 16 is configured and positioned to detect light 28 in wavelengths between about 500 to about 700 nm emitted by the fluorescing material contained in the printed printhead alignment pattern 24 formed by the aqueous ink. Controller 12 may include a processor and associated memory for executing program instructions for controlling the output of UV LED 14 and for reading the signal output of sensor 16 during a printhead alignment operation.

The present invention modifies the current printhead auto-alignment detector systems of the prior art, for example, in two ways. The first modification is in the ink. A fluorescing material is added to and mixed uniformly with the inks. The fluorescing material has a narrow absorbing band and narrow emitting band such that when the light within the narrow absorbing band excites on the mixed inks, the signal within the narrow emitting band comes only or mainly from the added fluorescing material (none or very little comes from the inks themselves). For example, a fluorescing material can be used that absorbs light in the non-visible spectrum of light (below 400 nm-UV) and re-emits light in the visible or near-IR spectrum of light (about 400 nm to 1000 nm).

In a preferred embodiment the UV fluorescing material can absorb light from a UV LED in the wavelengths between 250 nm to about 400 nm and emit in the visible range between about 500 nm to about 700 nm. The UV fluorescing material can be a dye or a pigment with dyes being preferred. Preferred dye colors include red (e.g., Keyfluor Red OB615, Keystone Invisible Fluorescent Red dye supplied by Keystone Aniline) and yellow (e.g., Keyplast Yellow 10G Keystone Fluorescent Yellow dye supplied by Keystone Aniline).

Other suitable fluorescent dyes include invisible or visible dyes and pigments that absorb energy of UV and visible light with wavelength from 254 nm to 700 nm and emit light with wavelength between 400 nm and 1.2 micron. Examples include organic fluorescent dye/pigments, such as derivatives of benzoxazine and benzoxazinone or complexes of rare earth elements. Other colorants such as fluorescent derivatives of dansyl chloride, coumarin, carbocyanine, naphthalamide, stilbene, squarine, perylene, xanthene, thioxanthene, thioindigoind, acridine, and anthrapyridone dyes and pigments would also be included for this application.

There are at least two methods of adding the fluorescing material to the inks. In the first method, the same fluorescing material would be added to all of the inks: cyan, magenta, yellow, and any other photo inks used. This fluorescing material would absorb in the UV band and re-emit in the visible or near-IR range of about 500 nm-1000 nm. This would avoid the optical brighteners added to paper that have emission peaks at around 400 nm-500 nm. The emission signal of fluorescent material in the ink should be strong enough to distinguish the emission of paper brightener at other visible wavelengths.

A second method is to use a different fluorescing material for each ink. Again, all of these materials would absorb at the same wavelength in the UV band (such as 365 nm) and re-emit in the visible to near IR (infrared) range of 500 nm-1000 nm, again avoiding the 400 nm-500 nm band where optical brighteners re-emit. However, the material in each ink would reflect at a wavelength that corresponds to that ink's color. For example, the material in cyan would reflect at around 500 nm, the material in magenta would reflect at around 700 nm, the material in yellow would reflect at around 600 nm.

There are other potential methods of adding fluorescing material(s) to the inks, but there are practical considerations that should dictate how this is done. Several common light sources have a UV component. This may affect the color of the printed image. Materials that re-emit in the near-IR are optimal since the re-emission spectrum will not interfere with the color. If a material is used that does re-emit in the visible, then it should re-emit at a wavelength that is compatible with the color of the ink.

The second modification to current auto-alignment technology for ink jet printers and all-in-one (AIO) devices is to the auto-alignment detector. First, with the present invention there only needs to be one LED 14 with a peak wavelength that is the same as or very close to the wavelength that the fluorescing material absorbs. This LED 14 preferably has a peak wavelength in the UV region (300 nm-400 nm). Also, sensor 16 blocks the 300 nm-500 nm range of wavelengths. This would block the reflected UV light from the LED 14 and the emission peaks from any optical brighteners in the paper. Thus the auto-alignment sensor unit would "see" all inks equally well and in some cases even better than what is possible with the current system.

These modifications to the auto-alignment detector will simplify the detecting system (one less LED) as well as improve the performance (all inks equally well detected). Other benefits could also include (but are not limited to) ink authentication, improved velocity optimization, improved and simplified performance of an "in-the-box" drop volume variability calibration that would otherwise require up to 3 LED's.

The aqueous inkjet ink compositions of the present invention comprise color pigment and a UV fluorescing material in an aqueous medium. The aqueous medium may comprise water, preferably distilled and/or deionized water, or may comprise water in combination with one or more water-miscible organic solvents. In a preferred embodiment, the aqueous medium is deionized water.

The UV fluorescing material can be water soluble or can be processed to a water miscible emulsion or dispersion.

A wide variety of organic and inorganic pigments are known in the art for use in inkjet printing systems and are suitable for use in the compositions of the present invention, alone or in combination. The pigment dispersion particles must be sufficiently small to permit free flow of the ink through the inkjet printing device, and particularly the ink jet print nozzles, which typically have diameters in the range of from about 10 to about 50 μm, and more typically of about 30 μm or less. The particle size of the pigment should also be selected to maintain pigment dispersion stability in the ink, and it is generally desirable to use smaller sized particles for maximum color strength. Accordingly, pigment dispersion particles having a size in the range of from about 50 nm to about 5 μm, and more preferably less than about 1 μm, are preferred.

Pigments which are suitable for use in the present compositions include, but are not limited to, azo pigments such as condensed and chelate azo pigments; polycyclic pigments such as phthalocyanines, anthraquinones, quinacridones, thioindigoids, isoindolinones, and quinophthalones; nitro pigments; daylight fluorescent pigments; carbonates; chromates; titanium oxides; zinc oxides; iron oxides and carbon black. In one embodiment, the pigment is other than a white pigment, such as titanium dioxide. Preferred pigments employed in the ink composition include carbon black and pigments capable of generating a cyan, magenta and yellow ink. Suitable commercially available pigments include, for example, Pigment Red 81, Pigment Red 122, Pigment Yellow 13, Pigment Yellow 14, Pigment Yellow 17, Pigment Yellow 74, Pigment Yellow 83, Pigment Yellow 128, Pigment Yellow 138, Pigment Orange 5, Pigment Orange 30, Pigment Orange 34, Pigment Blue 15:4 and Pigment Blue 15:3. The pigments may be prepared via conventional techniques.

The ink compositions may also include a dispersant, typically for dispersing the pigment therein. The dispersant may be polymeric or nonpolymeric. The term "polymeric dispersant" as used herein, is meant to include homopolymers, copolymers, terpolymers and immiscible and miscible polymer blends. Suitable non-polymeric dispersants include naphthalene sulfonic acid, sodium lignosulfate and glycerol stearate. Numerous polymeric dispersants are known in the art and are suitable for use in the present compositions. The polymeric dispersant may comprise a random polymer or a structured polymer, for example a block copolymer and/or branched polymer, or mixtures thereof, and the dispersant polymer may be anionic, cationic or nonionic in nature. Suitably, polymers having both hydrophilic sections for aqueous compatibility and hydrophobic sections for interaction with the pigment are preferred.

Suitable polymeric dispersants are known in the art, for example, in U.S. Pat. Nos. 5,821,283; 5,221,334; 5,712,338; and 5,714,538, all of which are incorporated herein by reference.

Alternatively, pigment known as a self-dispersed pigment can be used or mixtures of a self-dispersed pigment and a pigment with dispersant. Pigments known as self-dispersed pigments or self-dispersing have been created with a surface modification. Such pigments can be surface modified in a variety of ways including, but not limited to, treatment with alkali salts of hypochlorite, ozone, and diazonium salts of aromatic sulfonic acid additions. These surface modified pigments have the distinct advantage of being self-dispersed in aqueous media and can be used without a corresponding polymeric dispersing agent. The surface modification can be performed on both black and color pigments.

For the purposes of this invention, the polymeric dispersant composition is not critical as long as its use results in a stable and printable ink. Polymeric dispersants are typically used at 0.1 to 5 wt %, based on the total weight of the ink. Pigment dispersions can be made by mixing pigment, dispersant, water, and optional additives and milling in, for example, a horizontal media mill, a vertical media mill, and an attritor mill.

The aqueous ink jet compositions may also include a humectant. Humectants for use in ink jet ink compositions are known in the art and are suitable for use herein. Examples include, but are not limited to, alcohols, for example, glycols such as 2,2'-thiodiethanol, glycerol, 1,3-propanediol, 1,5-pentanediol, polyethylene glycol, ethylene glycol, diethylene glycol, propylene glycol and tetraethylene glycol; pyrrolidones such as 2-pyrrolidone; N-methyl-2-pyrrolidone; N-methyl-2-oxazolidinone; and monoalcohols such as n-propanol and iso-propanol.

Preferably the humectants are selected from the group consisting of alcohols, glycols, pyrrolidones, and mixtures thereof. Preferred humectants include 2,2'-thiodiethanol, glycerol, 1,3-propanediol, 1,5-pentanediol, polyethylene glycol, ethylene glycol, diethylene glycol, triethylene glycol, propylene glycol, tetraethylene glycol, 2-pyrrolidone, n-propanol and mixtures thereof.

The aqueous ink jet ink compositions according to the present invention may employ the pigment, humectant, and dispersant in amounts suitable for obtaining desired print properties. In preferred embodiments, the aqueous compositions comprise, by weight, from about 1% to about 20% pigment, from about 5% to about 50% humectant, and from about 0.01% to about 10% dispersant, and from about 0.01% to about 2% fluorescing material. More preferably, the compositions comprise, by weight, from about 1% to about 10% pigment, from about 10% to about 30% humectant, from about 0.1% to about 5% dispersant, and from about 0.05% to about 1% of the fluorescing material. Even more preferred, are compositions comprising, by weight, from about 4% to about 8% pigment, from about 15% to about 25% humectant, from about 0.1% to about 4% dispersant, and from about 0.1% to about 0.5% fluorescing material.

The ink compositions may further include conventional additives known in the art. For example, the compositions may comprise one or more biocides to allow long term stability. Suitable biocides include benz-isothiazolin-one, methyl-isothiazolin-one, chloro-methyl-isothiazolin-one, sodium dihydroacetate, sodium sorbate, sodium 2-pyridinethiol-1-oxide, sodium benzoate and sodium pentachlorophenol. Examples of commercially available biocides are Zolidine™, Proxel™, Givguard™, Canguard 327™ and Kathon® PFM. The compositions may further include fungicides, bactericides, penetrants, surfactants, anti-kogation agents, anti-curling agents and/or buffers, various examples of which are known in the art. The inkjet ink compositions suitably have a pH of from about 7.5 to about 8.5.

The aqueous ink jet ink compositions may be prepared in accordance with conventional processing techniques. Typically, the pigment is combined with the dispersant to provide a pigment dispersion which is then combined with additional components of the compositions. The compositions may be employed in ink jet printing methods in a conventional manner, wherein a droplet of the ink composition is ejected through a printhead nozzle in response to an electrical signal and onto a surface of a paper recording medium.

The present invention also encompasses printhead auto-alignment detection systems comprising the aqueous inkjet inks described above; a UV LED 14 that transmits light in the non-visible spectrum of light from 100 nm to about 400 nm, preferably in the wavelengths between 250 nm to about 400 nm; and a sensor 16 capable of detecting light in the wavelengths from the visible to near IR range of 500 nm-1000 nm, preferably between about 500 to about 700 nm.

The following examples are descriptions of the aqueous pigmented inkjet ink compositions and printhead auto-alignment detection systems of the present invention. The descriptions fall within the scope of, and serve to exemplify, the more general description set forth above. The examples are presented for illustrative purposes only, and are not intended as a restriction on the scope of the invention.

EXAMPLES

Example 1

Inks:

Ink 1: Lexmark Standard Pigment ink, Cyan, Magenta and Yellow

Ink 2: Lexmark Standard pigment ink plus 0.25% Keyplast® Fluorescent Yellow 10G emulsion (Dye supplied by Keystone Aniline, emulsion was processed in Lexmark)

Paper:

Two types of paper were printed, Lexmark Premium Photo paper and HammerMill Laser Print paper.

Detection Unit:

365 nm UV LED

Clear optical sensor with yellow filter

Detected signal (fluorescent emission) was converted into electric voltage and was measured using a multi-meter.

Figure 2:
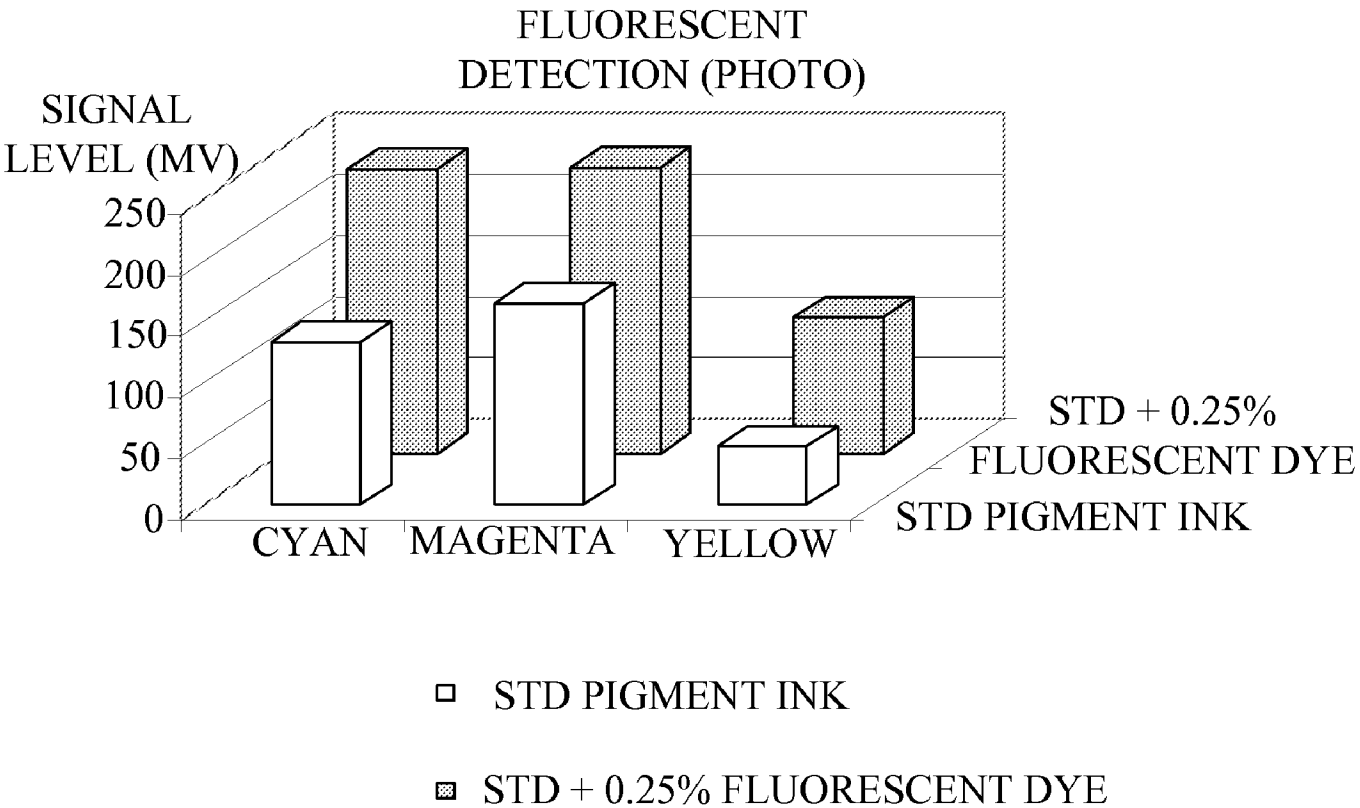
FIG. 2 shows the detected signal level (mv) on photo paper for color pigment inks with and without a 0.25% fluorescent yellow dye.
Figure 3:
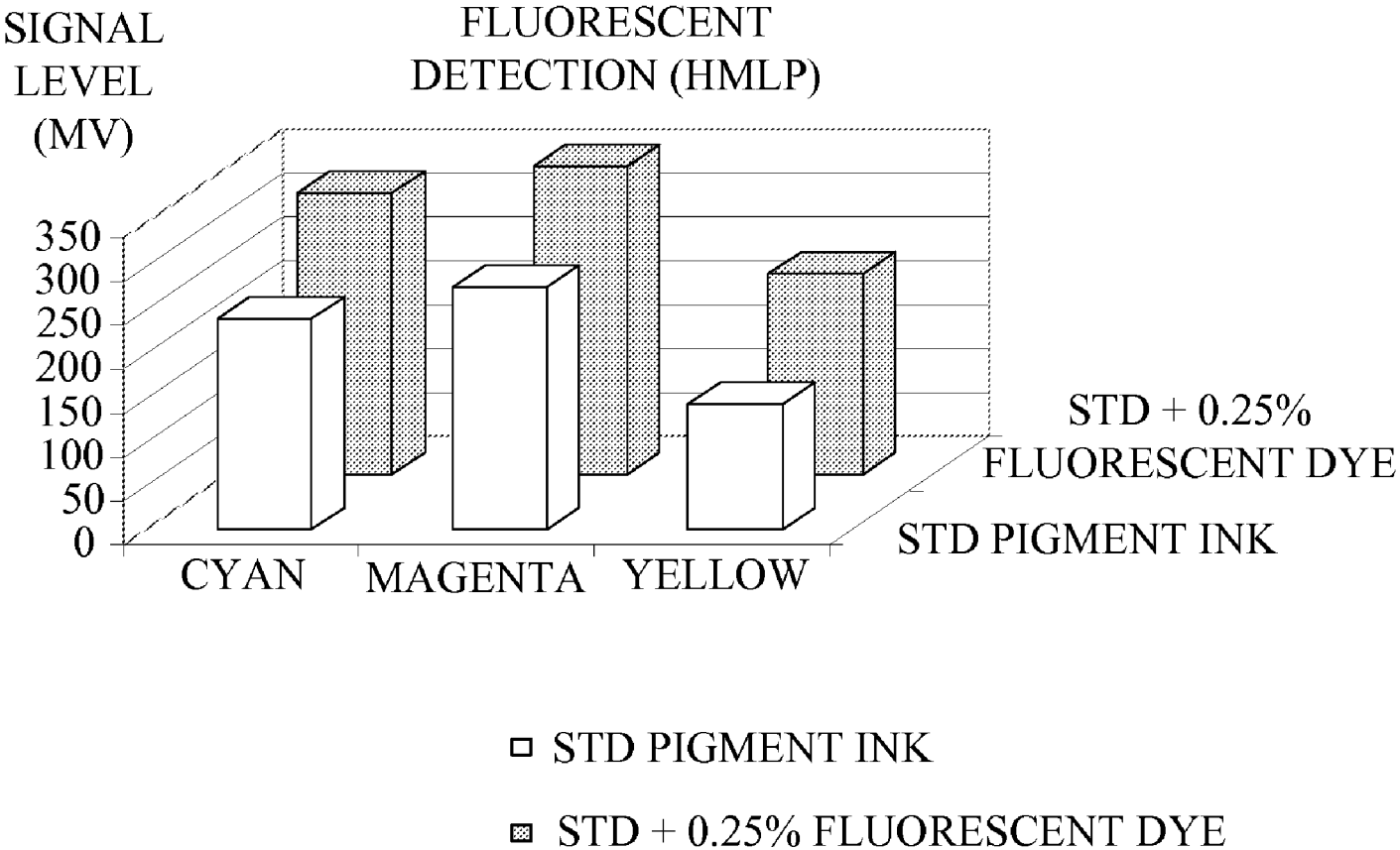
FIG. 3 shows the detected signal level (mv) on laser print paper for color pigment inks with and without a 0.25% fluorescent yellow dye.

Results:

The results are shown in FIG. 2 for Lexmark Premium Photo paper and in FIG. 3 for HammerMill Laser Print paper. As can be seen from FIGS. 2 and 3 the detecting unit, which consisted of only one LED and one sensor, can detect all three color inks in Ink 2 containing the 0.25% fluorescent dye.

Example 2

Inks

Ink 1: Lexmark Standard Pigment ink, Cyan, Magenta and Yellow

Ink 3: Lexmark Standard pigment ink plus 0.5% Keyfluor Red OB-615 emulsion (Keystone Invisible Fluorescent Red dye supplied by Keystone Aniline, emulsion was processed in Lexmark)

Paper:

Two types of paper were printed, Lexmark Premium Photo paper and HammerMill Laser Print Detection Unit:

365 nm (or 395 nm) UV LED

Clear optical sensor with Red filter

Detected signal (fluorescent emission) was converted into electric voltage and was measured using a multi-meter.

Figure 4:
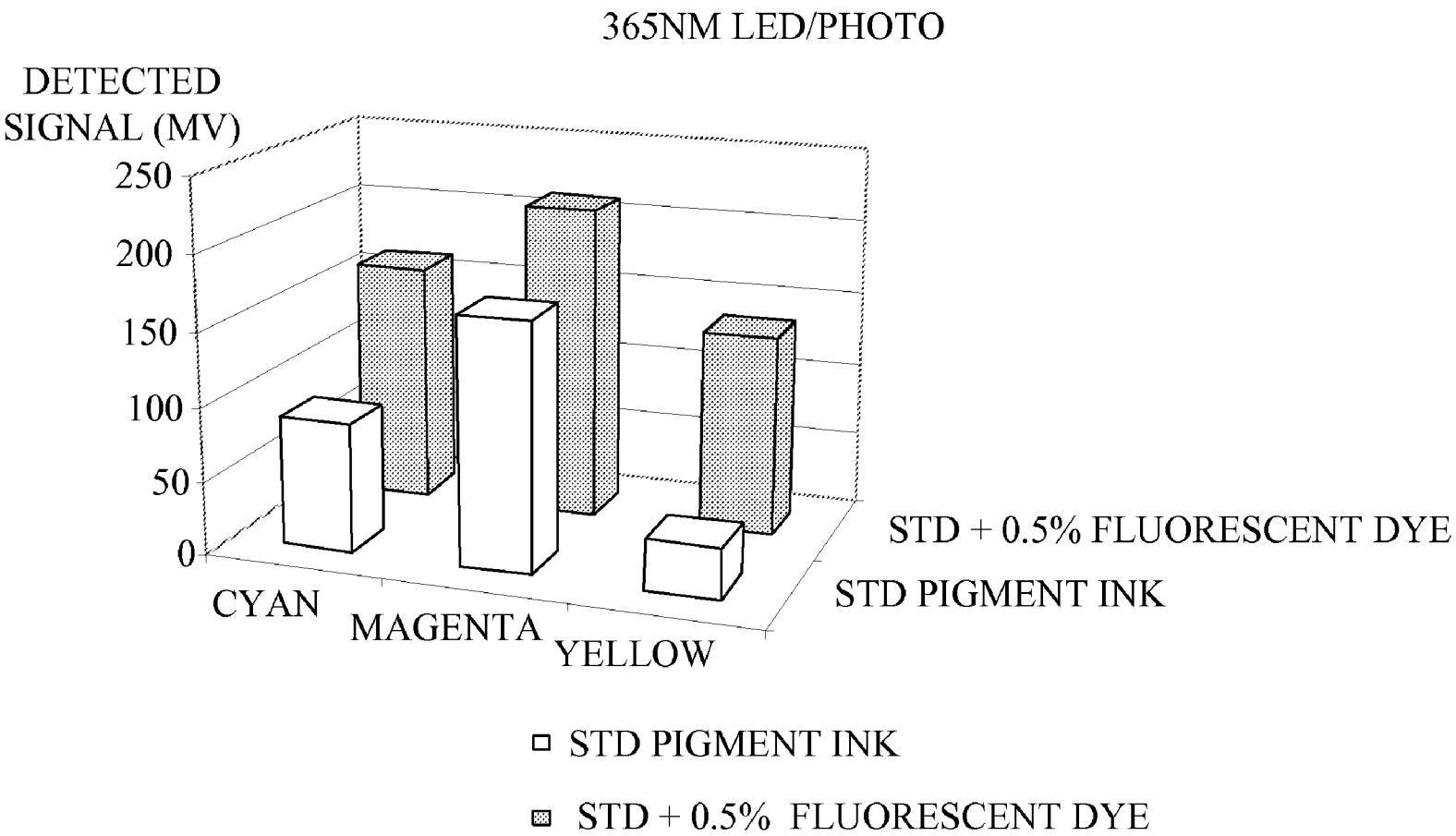
FIG. 4 shows the detected signal level (mv) on photo paper for color pigment inks with and without a 0.5% invisible fluorescent red dye.
Figure 5:
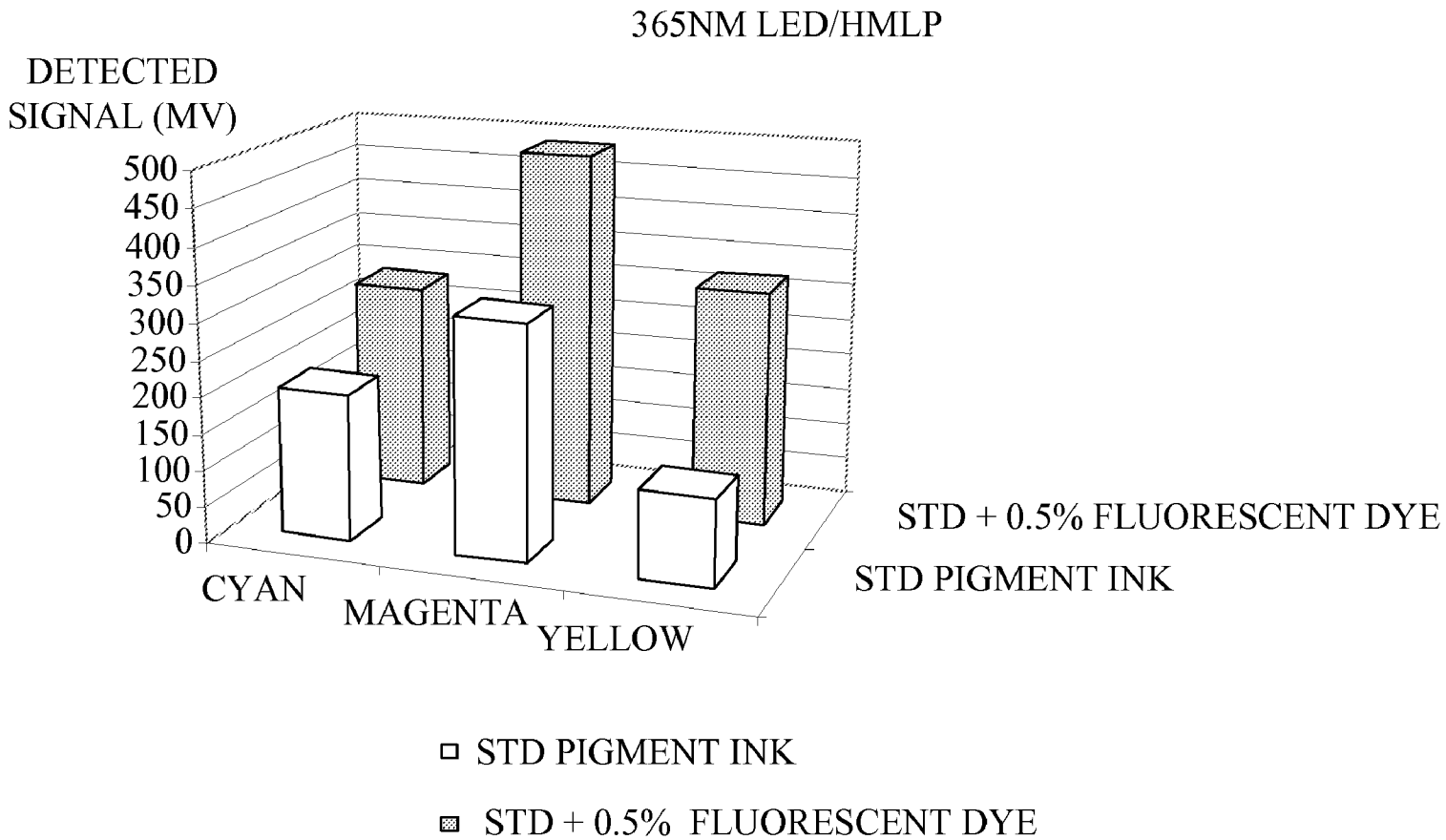
FIG. 5 shows the detected signal level (mv) on photo paper for color pigment inks with and without a 0.5% invisible fluorescent red dye.

Results:

The results are shown in FIG. 4 for Lexmark Premium Photo paper and in FIG. 5 for HammerMill Laser Print paper. As can be seen from FIGS. 4 and 5 the detecting unit, which consisted of only one LED and one sensor, can detect all three color inks in Ink 3 containing the 0.5% fluorescent dye.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead auto-alignment detection system, comprising:

a) a UV LED configured and positioned to transmit light in ultraviolet wavelengths onto a printed printhead alignment pattern formed using an aqueous ink having an added UV fluorescing material that absorbs light from said UV LED in the wavelengths in a range between 250 nm to about 400 nm and emits light in the wavelengths in a range between 500 nm to 700 nm, wherein said UV fluorescing material is a dye or pigment;

b) a sensor configured and positioned to detect light in visible wavelengths emitted by said fluorescing material and to block light with wavelength between 300 nm to 500 nm; and c) a controller communicatively coupled to said UV LED and said sensor, said controller being configured to execute program instructions for controlling the output of said UV LED and for reading a signal output of said sensor during a printhead alignment operation.

2. The printhead auto-alignment detection system of claim 1, wherein the fluorescing material comprises from about 0.01% to about 2.0% of the aqueous ink.

3. The printhead auto-alignment detection system of claim 1, wherein said UV fluorescing material is a dye.

4. The printhead auto-alignment detection system of claim 3, wherein said dye comprises from about 0.05% to about 1.0% of said aqueous ink.

5. The printhead auto-alignment detection system of claim 4, wherein said dye comprises from about 0.1% to about 0.5% of the aqueous ink.

6. The printhead auto-alignment detection system of claim 1, wherein said UV fluorescing material is a red or yellow dye.

7. The printhead auto-alignment detection system of claim 1, wherein said UV fluorescing material is a red dye.

8. The printhead auto-alignment detection system of claim 1, wherein said UV fluorescing material is a yellow dye.

9. A printhead auto-alignment detection system, comprising:

a) a printed printhead alignment pattern formed by an aqueous inkjet ink having a UV fluorescing material that absorbs light in the wavelengths between 250 nm to 400 nm and emits in the visible range between 500 nm to 700 nm, wherein said UV fluorescing material is a dye or pigment:

b) a UV LED configured and positioned to transmit light in wavelengths between 250 nm to about 400 nm onto said printed printhead alignment pattern;

c) a sensor configured and positioned to detect light in wavelengths between about 500 to about 700 nm emitted by said fluorescing material of said printed printhead alignment pattern; and d) a controller communicatively coupled to said UV LED and said sensor, said controller being configured to execute program instructions for controlling the output of said UV LED and for reading a signal output of said sensor during a printhead alignment operation.

10. The printhead auto-alignment detection system of claim 9, wherein the fluorescing material comprises from about 0.01% to about 2.0% of the aqueous ink.

11. The printhead auto-alignment detection system of claim 9, wherein said UV fluorescing material is a dye.

12. The printhead auto-alignment detection system of claim 11, wherein said dye comprises from about 0.05% to about 1.0% of said aqueous ink.

13. The printhead auto-alignment detection system of claim 12 wherein said dye comprises from about 0.1% to about 0.5% of the aqueous ink.

14. The printhead auto-alignment detection system of claim 9, wherein said UV fluorescing material is a red or yellow dye.

15. The printhead auto-alignment detection system of claim 9, wherein said UV fluorescing material is a red dye.

16. The printhead auto-alignment detection system of claim 9, wherein said UV fluorescing material is a yellow dye.

* * * * *